US005671765A

United States Patent [19]

Hagberg, Jr.

[11] Patent Number: 5,671,765

[45] **Date of Patent: *Sep. 30, 1997**

[54] FOREARM CRUTCH

[76] Inventor: Nils G. Hagberg, Jr., 4219 Maple Ave., Oakland, Calif. 94602

[ * ] Notice: The term of this patent shall not extend beyond the expiration date of Pat. No. 5,564,451.

[21] Appl. No.: 685,541

[22] Filed: Jul. 24, 1996

Related U.S. Application Data

[63] Continuation-in-part of Ser. No. 391,533, Feb. 21, 1995, Pat. No. 5,564,451.

[51] Int. Cl.[6] ..... A61H 3/02

[52] U.S. Cl. ..... 135/68; 135/71

[58] Field of Search ..... 135/66, 68, 71, 135/72, 74, 75

[56] References Cited

U.S. PATENT DOCUMENTS

| | | | |
|---|---|---|---|
| 1,244,249 | 10/1917 | Schlick | 135/71 |
| 2,575,681 | 11/1951 | Peters | 135/68 |
| 2,711,183 | 6/1955 | Lofstrand | 135/50 |
| 2,788,793 | 4/1957 | Abbott | 135/68 |
| 2,811,978 | 11/1957 | Russell | 135/45 |
| 3,157,187 | 11/1964 | Murcott | 135/49 |
| 3,157,188 | 11/1964 | Farnham | 135/50 |
| 3,157,189 | 11/1964 | Farnham | 135/50 |
| 3,486,515 | 12/1969 | Chrysostomides | 135/50 |
| 3,635,233 | 1/1972 | Robertson | 135/47.5 |
| 3,710,807 | 1/1973 | Ferry | 135/49 |
| 3,731,920 | 5/1973 | Matsuda | 272/57 E |
| 3,757,807 | 9/1973 | Manzo | 135/47.5 |
| 3,768,495 | 10/1973 | Smith | 135/51 |
| 3,995,650 | 12/1976 | DiVito | 135/72 |
| 3,999,565 | 12/1976 | Delacour | 135/65 |
| 4,085,763 | 4/1978 | Thomas | 135/69 |
| 4,151,853 | 5/1979 | Inbar | 135/71 |
| 4,237,915 | 12/1980 | Zabielski et al. | 135/68 |
| 4,237,916 | 12/1980 | Harrison et al. | 135/69 |
| 4,248,256 | 2/1981 | Thomas | 135/67 |
| 4,434,808 | 3/1984 | Burak | 135/80 |
| 4,510,957 | 4/1985 | Frank | 135/84 |
| 4,708,154 | 11/1987 | Edwards | 135/84 |
| 4,869,280 | 9/1989 | Ewing | 135/69 |
| 4,958,651 | 9/1990 | Najm | 135/82 |
| 5,036,873 | 8/1991 | Clayton | 135/69 |
| 5,038,811 | 8/1991 | Gilmore | 135/71 |
| 5,139,040 | 8/1992 | Kelly | 135/69 |
| 5,178,176 | 1/1993 | Fetterman | 135/86 |
| 5,193,567 | 3/1993 | Razny, Jr. | 135/68 |
| 5,287,870 | 2/1994 | Rhodes | 135/72 |
| 5,291,910 | 3/1994 | Cuong | 135/68 |
| 5,299,589 | 4/1994 | Zatulovsky | 135/68 |
| 5,329,954 | 7/1994 | Miyoshi | 135/71 |
| 5,331,989 | 7/1994 | Stephens | 135/65 |
| 5,339,849 | 8/1994 | Stutz | 135/66 |
| 5,339,850 | 8/1994 | Mertz | 135/72 |
| 5,351,702 | 10/1994 | Denjean | 135/71 |
| 5,482,070 | 1/1996 | Kelly | 135/66 |
| 5,555,904 | 9/1996 | Stockwell | 135/68 |
| 5,564,451 | 10/1996 | Hagberg | 135/68 |

FOREIGN PATENT DOCUMENTS

| | | | |
|---|---|---|---|
| 8900039 | 1/1989 | WIPO | 135/71 |

*Primary Examiner*—Lanna Mai
*Attorney, Agent, or Firm*—Michael J. Mazza

[57] ABSTRACT

A walking aid or crutch which includes a vertical support member which preferably incorporates a shock-absorbing means therein, and a forearm support, angularly mounted on the vertical support member over an angular range of about 25 to 89 degrees from the vertical to optimize weight distribution and user comfort. The forearm support comprises a linearly disposed forearm cradle and a handle, to further optimize weight distribution, stability and user comfort. The handle may be angled inward toward the center line of the body so that the user's forearm is pronated about five degrees, with weight distributed along the ulnar edge of the forearm adjacent to the elbow joint, and the ulnar border of the hand (fifth metacarpal) is also pronated about five degrees as the fingers engage the support arm handle. The handle may also have a downward angle (in the direction of motion) to create an ulnar deviation of about fifteen degrees beginning at the wrist joint as the hand engages the handle.

20 Claims, 5 Drawing Sheets

45
48
Δ
D
15
D
40A
52
44
C
46
47
50
70
24
46B
16
55
54
C
54

FOREARM CRUTCH

CROSS REFERENCE TO RELATED APPLICATIONS

This is a Continuation-in-Part of Ser. No. 08/391,533, filed Feb. 21, 1995 now U.S. Pat. No. 5,564,451.

FIELD OF THE INVENTION

This invention relates to crutches or walking aids; and specifically to an improved forearm-type or "Canadian" crutch.

DISCUSSION OF RELATED ART

Forearm crutches have traditionally been made in various fixed lengths. Improvements to the crutch have focused on making the length of the crutch adjustable, for example, as shown by Harrison-Smith, et al. U.S. Pat. No. 4,237,916 and Inbar, U.S. Pat. No. 4,151,853. A patent for making a crutch collapsible was issued to Ewing, U.S. Pat. No. 4,869,280. Different types of locking mechanisms to control crutch length, for example Ferry, U.S. Pat. No. 3,710,807, have also been granted.

Further patents have addressed different types of tips to improve crutch stability when it makes contact with ground. U.S. Pat. No. 5,038,811 to Gilmore describes modifying the cuff to make it self-opening. The shape of the grip/handle, Rhodes, U.S. Pat. No. 5,287,870; Inbar, U.S. Pat. No. 4,151,853; and Mertz, U.S. Pat. No. 5,339,850, has also been modified. The type of material used in the grip varies. However, the basic design of the forearm crutch, shown in Lofstrand, U.S. Pat. No. 2,711,183, has not significantly changed since 1955.

A major fundamental problem of the forearm crutch as it now exists is that the user must support all of the body's weight through the hands causing the user to position the body with the shoulders forward, or protracted, resulting in poor spinal alignment for walking. As a result, some individuals are unable to use the forearm crutch due to their lack of physical strength. For those who can use the crutch, a major problem reported is physical fatigue and numbness of the hands. The numbness is associated with nerve and circulatory problems due to the weight borne by the hands. With the shoulders rolled forward in the protracted position, other physiological problems of the neck, back and spine may develop, further compromising the individual's physical health. While the prior art has addressed improving the various components of the forearm crutch, none has addressed the physiological problems incurred by the user.

SUMMARY OF THE PRESENT INVENTION

The present invention provides an improved forearm crutch which affords the user greater ease of use through reduction in the weight that must be borne by the user's hands. The user's weight is supported by a collinear forearm cradle and handle, angularly mounted on a vertical support. The handle is preferably angled inward toward the center line of the body so that the user's forearm is pronated about five degrees, with weight distributed along the ulnar edge of the forearm adjacent to the elbow joint, and the ulnar border of the hand (fifth metacarpal) is also pronated about five degrees as the fingers engage the support arm handle. The handle also preferably has a downward angle (in the direction of motion) to create an ulnar deviation of about fifteen degrees beginning at the wrist joint as the hand engages the handle.

It is accordingly an object of the walking aid of the present invention that the weight of the body borne by the hands is substantially reduced.

It is another object of the present invention that the user's shoulders are urged back, or retracted, thereby resulting in a proper spinal curvature for walking.

It is a further object of the present invention that user comfort is enhanced, while maintaining good stability.

It is yet another object of the present invention that it can be readily adjusted to optimize comfort and stability for users of varying size and physiological conditions.

It is a still further object of the present invention that it can be readily manufactured in a range of fixed configurations to optimize comfort and stability for users of varying size and physiological conditions.

It is yet another object of the present invention that it is simple to manufacture.

Briefly, in a first embodiment of the present invention, the crutch generally comprises a vertical elongate support which preferably incorporates a shock-absorbing means therein, and a forearm support, which is in mechanical communication with the vertical elongate support over an angular range of about 1 to 75 degrees downward from a horizontal plane to optimize weight distribution and user comfort. As used herein, the term "mechanical communication" refers to the joining, directly or indirectly, of two or more components, parts or elements whereby a load or force may be transmitted between them. Mechanical communication, or "communication" encompasses components, parts or elements immovably fixed or secured to one another, and/or joined in an adjustable or movable fashion, for example, about a pivot point, or slidably displaceable with respect to each other. The term "adjustably secured" may be used herein to denote a relationship wherein two or more components, parts or elements may be varied, incrementally or continuously, with respect to each other, but such variation is preselected by the user prior to use of the crutch, and there is no positional variation while the crutch is in use. Components, parts or elements may be adjustably secured about rotational, or displaceable axes, or a combination thereof. The forearm support comprises a forearm cuff and a hand grip, linearly adjustable relative to each other to further optimize weight distribution and user comfort. The crutch of the present invention is constructed of a strong, lightweight material such as a light metal alloy or plastic. Weight can be further decreased by tubular construction and/or by reducing material thickness or material removal as appropriate.

It is accordingly an advantage of the walking aid of the present invention that the weight of the body borne by the hands is substantially reduced.

It is another advantage of the present invention that the user's shoulders are urged back, thereby resulting in a proper spinal curvature for walking.

It is a further advantage of the present invention that user comfort is enhanced while stability is maintained.

It is yet another advantage of the present invention that it can be readily adjusted to optimize comfort and stability for users of varying size and physiological conditions.

It is yet another advantage of the present invention that it is simple to manufacture.

It is another advantage that the crutch of the present invention is does not require extensive user manipulation, making it well suited to those who are unable to do so, or for whom manipulation difficulties are compounded by the need to employ two crutches.

These and other objects and advantages of the present invention will no doubt become obvious to those of ordinary skill in the art after having read the following detailed description of the preferred embodiment as illustrated by the various drawing figures.

IN THE DRAWINGS

DETAILED DESCRIPTION OF THE PREFERRED EMBODIMENTS

Figure 1:
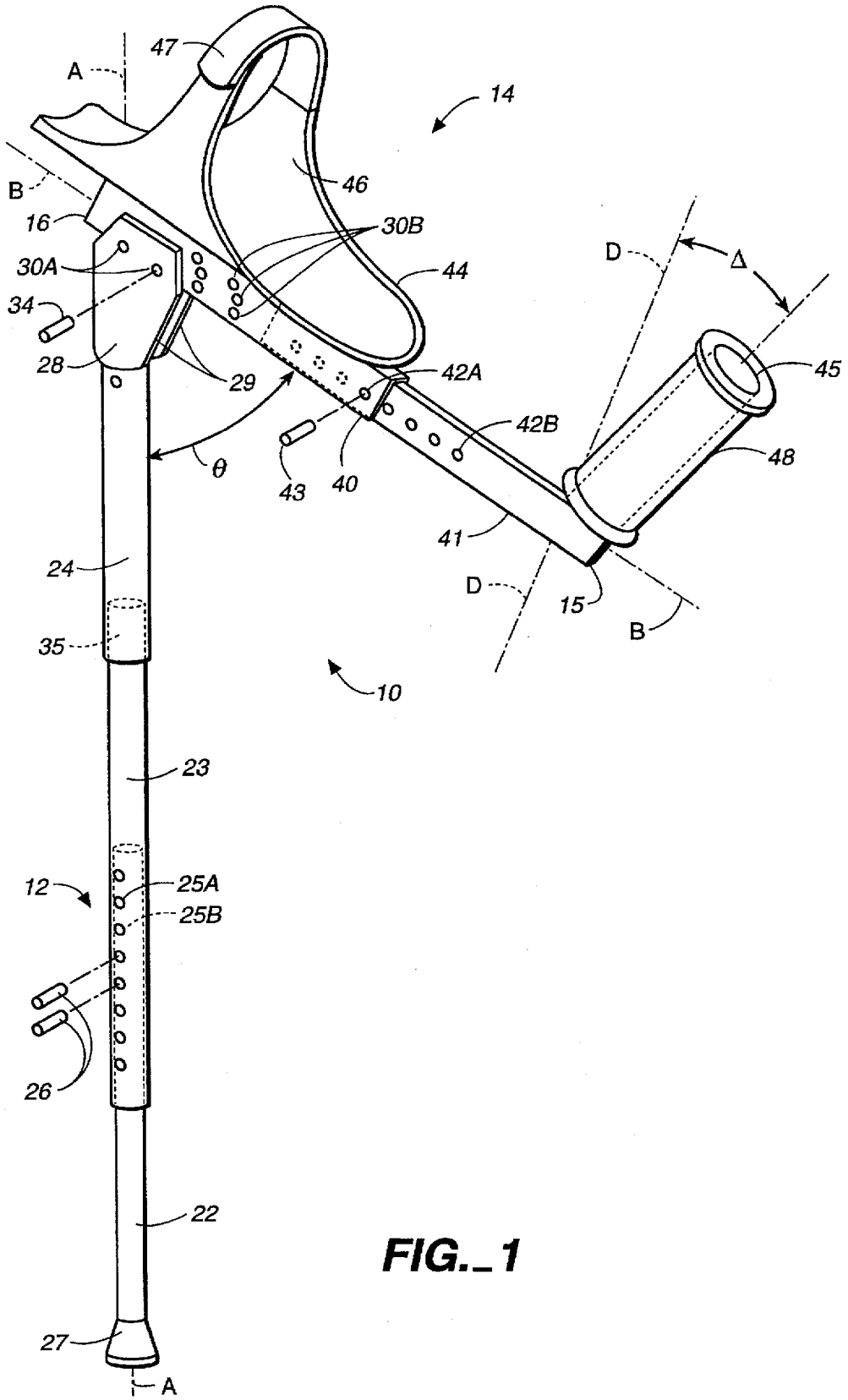
FIG. 1 is a perspective view of the crutch of the present invention.

Referring to the drawings, and in particular to FIG. 1, there is shown a crutch or walking aid of the present invention and referred to by the general reference numeral 10. The walking aid 10 comprises a generally vertically-disposed vertical elongate shaft 12 and a generally non-vertically disposed forearm support 14. The forearm support 14 includes a first end 15, and a second end 16, wherein the vertical elongate shaft 12 may mechanically communicate with, be adjustably secured to, or attached to, the forearm support 14 at any point between the ends 15 and 16.

The vertical elongate support 12 has a central vertical axis AA, and preferably comprises a lower shaft 22 for contacting a walking surface, an intermediate shaft 23 which engages the lower shaft 22, and an upper shaft 24 which also engages the intermediate shaft 23, and which further engages the forearm support 14. The shafts 22 and 23 communicate in a telescoping fashion to provide a means of adjusting the overall height of the walking aid 10. The height adjustment may be through any means known to the art to achieve the height adjustment on either an incremental or continuous basis. An internally expandable friction lock could be used to provide continuous height adjustment. For manufacturing simplicity an incremental or stepwise adjustment is preferred, such as one or more threaded fasteners and locknuts, detents or self-locking, e.g. clevis pins. A pin and corresponding aperture arrangement, as shown in FIG. 1, is most preferred. Thus the shafts 22 and 23 each contain a series of regularly spaced apertures 25A and 25B, respectively, through which a pin or pins 26 may be inserted to secure the shaft 22 to the shaft 23. If desired, the pin 26 may be integrally formed into the shaft 22 or 23 and a spring or other suitable biasing means (not shown) may be incorporated to impart a self-locking capability to the pin 26. Alternatively, the pins 26 and apertures 25A and/or 25B may be threaded to permit locking. A lower or distal end of the shaft 22 may include a resilient, shock absorbing and anti-skid tip 27, formed preferably of a rubber or plastic material. At an upper or proximal end of the shaft 24 there is a angular means 28 for pivotably affixing the vertical elongate support 12 to the forearm support 14. The angular support means 28 includes adjustment means to allow a user to alter the angle of the forearm support 14 relative to the vertical elongate support 12, and further for allowing the user to position the forearm support 14 about a longitudinal dimension thereof. Referring to FIG. 1, the angular support means 28 comprises a generally flat plate 29 secured to the proximal end of the shaft 24, and in the most preferred embodiment comprises two congruent opposed plates 29 with the forearm support 14 engaged intermediate thereto. In the preferred embodiment, the adjustment means comprises a pair of apertures 30A through the plates 29 which align with a pair of apertures 30B of the forearm support 14, and are locked together by a pair of locking pins 34 (illustrated also in FIG. 2). The vertical elongate support is also preferably supplied with a shock absorbing means 35 to soften forces transmitted to user through the forearm support 14 as the user walks.

The forearm support 14 preferably comprises a pair of arms 40 and 41 which slidebly mate in a telescoping manner and through which runs a central longitudinal axis BB. The first end 15 thus terminates one end of the arm 41, while the second end 16 of the forearm support 14 terminates one end of the arm 40. A forearm cuff 44 is secured to the arm 40, and a handle 45 is secured to the arm 41. The arms 40 and 41 possess a securing or locking mechanism such as disclosed hereinbefore with reference to the vertical support 12, and preferably comprise paired apertures 42A and 42B, formed through arms 40 and 41 respectively, and secured by a pin or pins 43. It is to be noted that any of the locking or securing means disclosed herein may be utilized for locking or securing any two movable parts of the present invention. The cuff 44 comprises an arcuate forearm cradle 46 shaped to be generally congruent to a lateral or ulnar surface of a human forearm. The cradle 46 is designed to maximize contact with a user's forearm for weight distribution, and is formed of a supportive, yet resilient material, such as a plastic or rigid fabric. Preferably, a central portion of the cradle 46 curves upwardly to engage and support the forearm about a surface over the ulna bone (ulnar surface.) As shown more specifically in FIG. 2, the cradle 46 preferably includes an arm restraining means such as a strap 47 to encircle the forearm about a surface above the radius bone (radial surface) thereby securing the user's arm thereto. The cradle 46 includes a posterior end 46B, distal to the user's elbow, a center axis CC and a proximal end 46A. While the exact dimensions of the cradle 46, and its position relative to the handle 45 are not critical, the dimensions are selected such that the posterior end 46B extends to a length sufficient to fully encompass or contain a user's elbow. Similarly, the center axis CC is selected to be about 2 to 5, preferably 1 to 3 inches from the posterior end 46B. It is most preferred, however, that the centerline CC of the cradle 46 not extend beyond the end 16 of the forearm support 14. By slidably positioning the arms 40 and 41, the cuff 44 and handle 45 are linearly adjustable with respect to each other to optimize weight distribution and user comfort. The handle 45 is sized to permit a user to grip it, and is preferably covered with a resilient material 48 such as a rubber or plastic. It is also preferred that the handle 45 be tilted slightly downward relative to a perpendicular axis DD (which is coplanar with axes AA and BB and perpendicular to axis BB) such that an angle delta ($\Delta$) is formed (depicted also in FIG. 2) of between about 0 and 40 degrees, preferably about 1–30 degrees, more preferably about 5–20 degrees, and most preferably about 10–18 degrees. This inclination results in an upper end of the handle 45 extending about 0.5 to 2 inches, preferably 0.25 to 1 inches beyond the first end 15 of the forearm support 14. The handle 45 may also be inclined slightly inward toward the user, in a direction parallel to axis CC and perpendicular to axes DD and BB. This inclination should be between about 0–20 degrees, preferably about 1–15 degrees and most preferably about 3–8 degrees.

Ideally, the combined result of the downward tilt and inward inclination is that the user's ulnar border of the hand (fifth metacarpal) is pronated about five degrees, while there is an ulnar deviation of about fifteen degrees beginning at the wrist joint, as the fingers engage the handle 45. Generally, it is contemplated that the handle 45 is fixed at preselected downward and inward angles, however it is within the scope of the invention to supply a securing, or adjustable securing, means, such as a lockable ball joint, or any other securing means disclosed herein, to the handle 45 to permit such alignment by the user.

The strap 47 may be a one piece elastomeric material so that the user can simply slip the forearm therethrough along axis BB, or it may be separable such that the user can position the forearm into the cuff 44 from the top, that is along axis DD. In this case the strap 47 should be made to permit one-handed securing and releasing, as if made from an interlocking material such as VELCRO, for example. Alternatively, the strap 47 may be two opposed congruent pieces of a semi-rigid material such as plastic or stainless steel strap, which will be sufficiently yielding to permit the user to insert the forearm from the top, but which will then spring back to retain the forearm. This has the advantage of not requiring manipulation by the user's other arm and hand.

Figure 2:
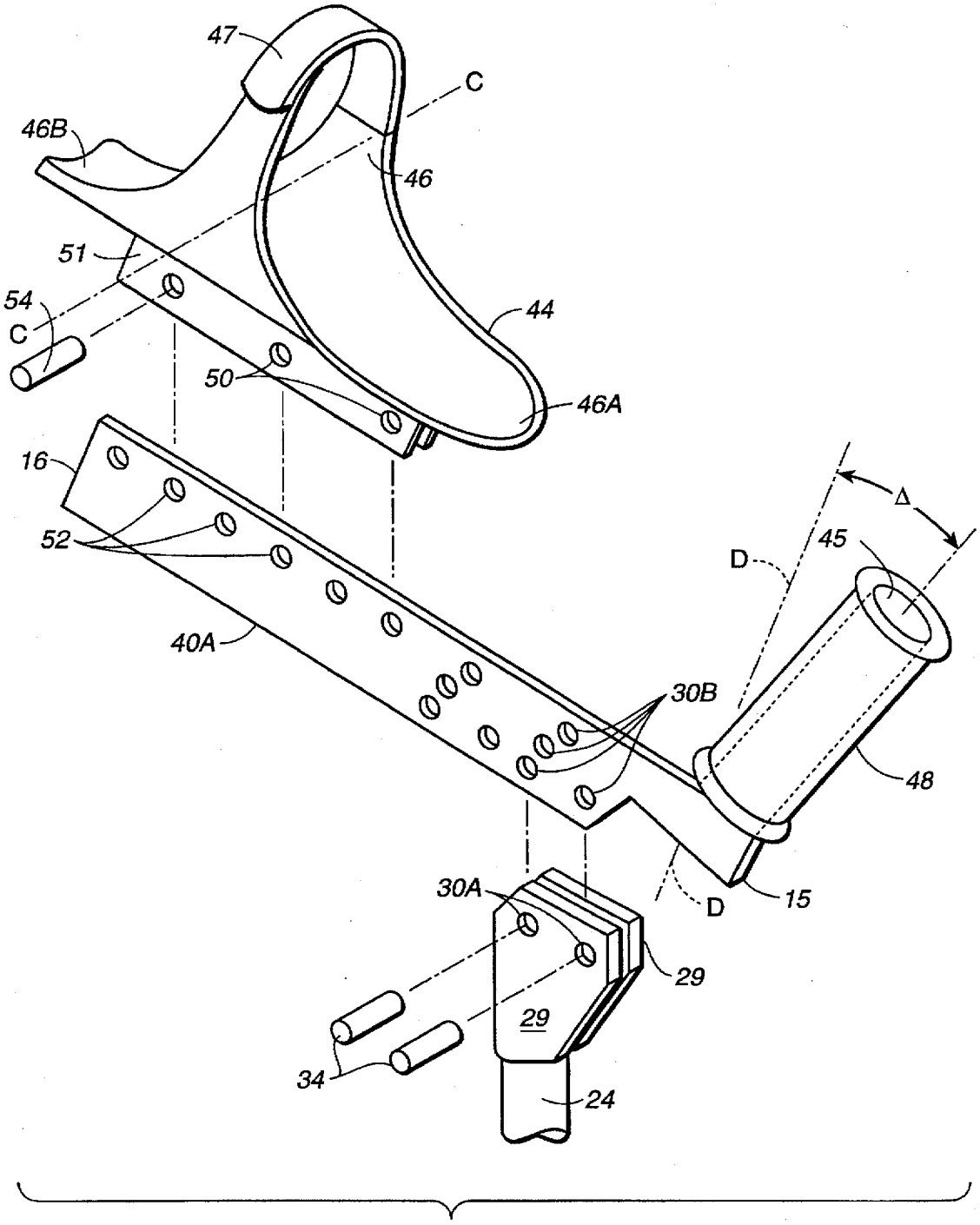
FIG. 2 is exploded detail view of an alternative embodiment of the forearm support of FIG. 1.

In an alternative embodiment of the forearm support, depicted in FIG. 2, there is a single arm 40A, with the handle 45 fixed thereto, for example by forming from a single piece of material, such as aluminum or a plastic. The cuff 44 is slidably mounted on the arm 40A to provide lateral adjustibility along axis BB. Provision for such lateral adjustment is supplied by any means known to the art, for example as disclosed hereinbefore in connection with securing the shafts 22 and 23, and in the preferred embodiment comprises one or more apertures 50 formed through a bracket 51 of the cuff 44, which align with a corresponding number of apertures 52 in the arm 40A, and are secured by pins 54.

Referring again to FIG. 1, the forearm support 14 mechanically communicates with the lower elongate support 12 via the angular support 28, and preferably is adjustably secured thereto to permit an an angle theta (θ) formed by axes AA and BB (depicted in FIG. 1) of between about 25–89, preferably between about 30–85, more preferably between about 45–80 degrees, and most preferably is about 70–75 degrees. Preferably, the vertical support 12 can be adjustably secured to, or attached to, the forearm support 14 at any point along the support arm 40. It has been found that user stability and comfort are both at an optimum when the vertical elongate support 12 is attached to the arm 40 at a point distal to the handle 45 and posterior to a midpoint of the forearm cradle 46. Most preferred is to locate the support 12 posterior to a substantial portion of the cradle 46, placing the vertical elongate support 12 generally under the user's elbow. In practice, the position of the forearm support 14 relative to the vertical elongate support 12 is satisfactory if about five centimeters (about 2 inches), preferably about 2–3 centimeters (0.75 to 1.25 inches), posterior to a midpoint of the cradle 46. Under dynamic load conditions (i.e. walking) in this configuration, flexing of the vertical support 12 is minimized or eliminated, thus minimizing or eliminating the resulting change such flexing would induce in the preselected angle θ of the forearm support 14.

Figure 3:
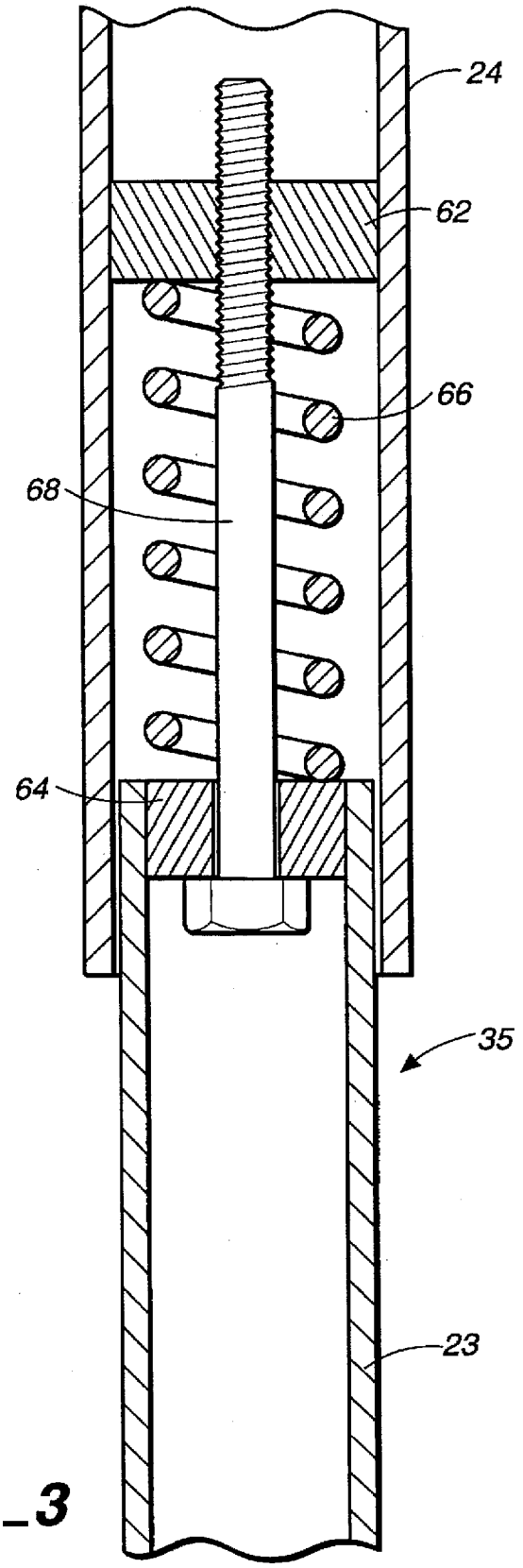
FIG. 3 is a detail view, in partial cutaway, of the shock absorbing means of the vertical elongate shaft.

For purpose of enhancing user comfort, the vertical support 12 is preferably provided with the shock absorbing means 35, shown in more detail in FIG. 3. The shock absorbing means 35 may be positioned at anywhere about the lower elongate support 12 as known to the art, and in the preferred embodiment is intermediate to the lower shaft 22 and the intermediate shaft 23. Most preferably, as depicted in FIG. 3, the shock absorbing means 35 includes a disk 62 secured within the upper shaft 24, the disk 62 having a central threaded aperture. Intermediate shaft 23 also contains a fixed disk 64 with a central aperture. A spring 66, having a diameter just slightly less than an inside diameter of the upper shaft 24 is contained therein such that the spring 66 may freely expand and compress vertically. An upper end of the spring 66 abuts the disk 62, while a lower end of the spring 66 abuts the disk 64, as the intermediate shaft 23 telescopes into a lower end of the upper shaft 24. The intermediate shaft 23 is secured to the upper shaft 24 by a bolt 68 which passes through the disk 64 and is threaded into the disk 62. By removing the intermediate shaft 23 from the upper shaft 24, the user can turn the bolt 68 to control the amount of force required to compress the spring 66, thereby controlling the distance the intermediate shaft 23 can move vertically. It is also within the scope of the present invention to provide a non-adjustible shock absorbing means 35, such as by inserting a solid elastomeric material intermediate to at least two of the shafts 22, 23 or 24, or intermediate to the forearm support 14 and the vertical support 12.

It is also preferred that the crutch be adjusted as described above such that certain physiological conditions are attained for optimum user stability and comfort. Ideally, the positioning of the user's arm within the forearm cuff 44, and hand position resulting from the downward tilt and inward inclination of the handle 45, is that the user's ulnar border of the hand (fifth metacarpal) is pronated about five degrees, while there is an ulnar deviation of about fifteen degrees beginning at the wrist joint, as the fingers engage the handle 45. In general, user stability is maximized as the angle θ formed by the vertical support 12 and the forearm support 14 approaches the minimum of about 25 degrees, and the user's elbows are at there point of fullest extension. On the other hand comfort is maximized with the reverse conditions, i.e. a large angle θ (89 degrees) and greatest elbow flex angle. Additionally, stability is best with the vertical elongate support 12 positioned posterior to the forearm cradle 46, as closely as possibly to be under the user's elbow.

Figure 4:
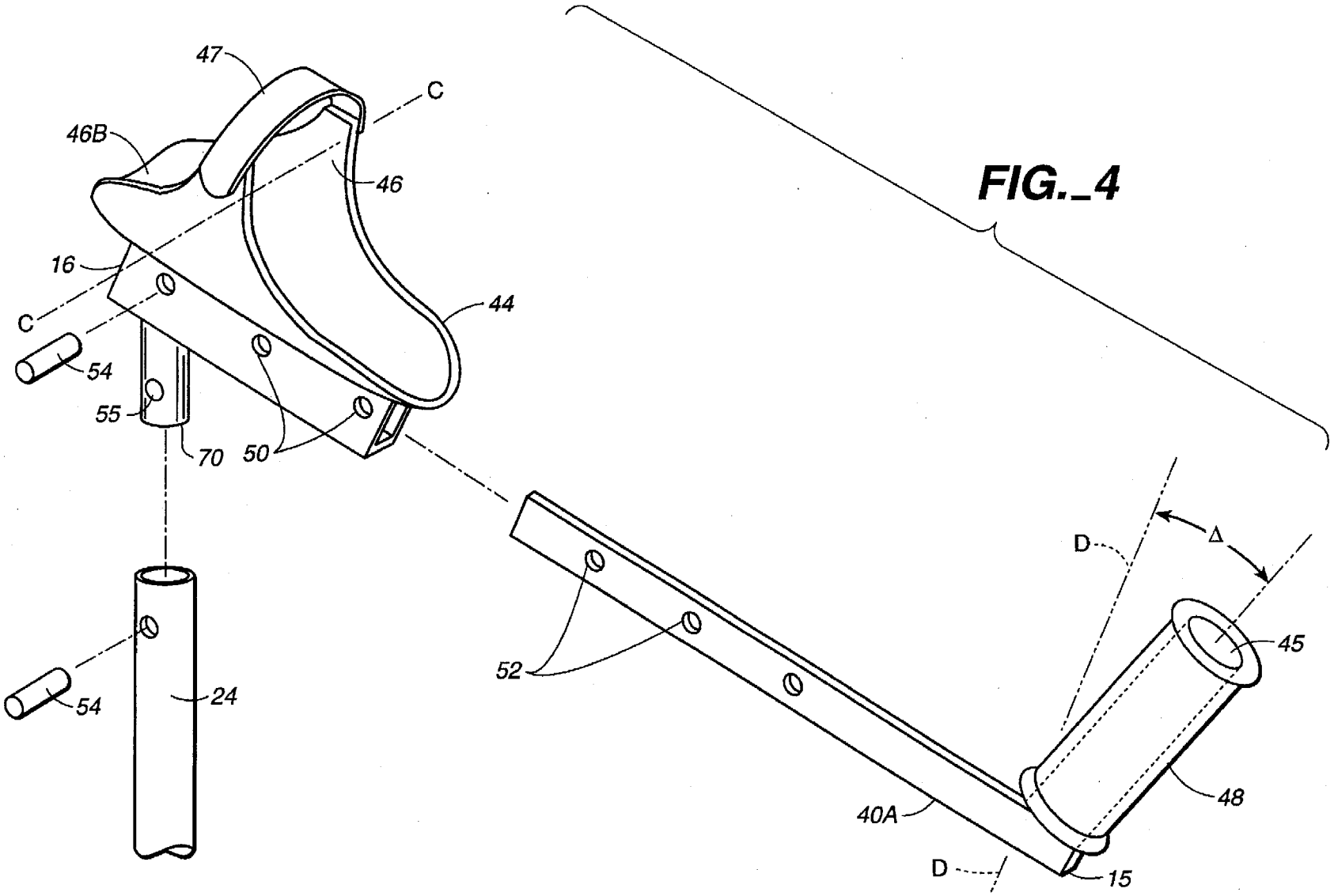
FIG. 4 is an exploded detail view of a first alternative embodiment of the crutch of the present invention.
Figure 5:
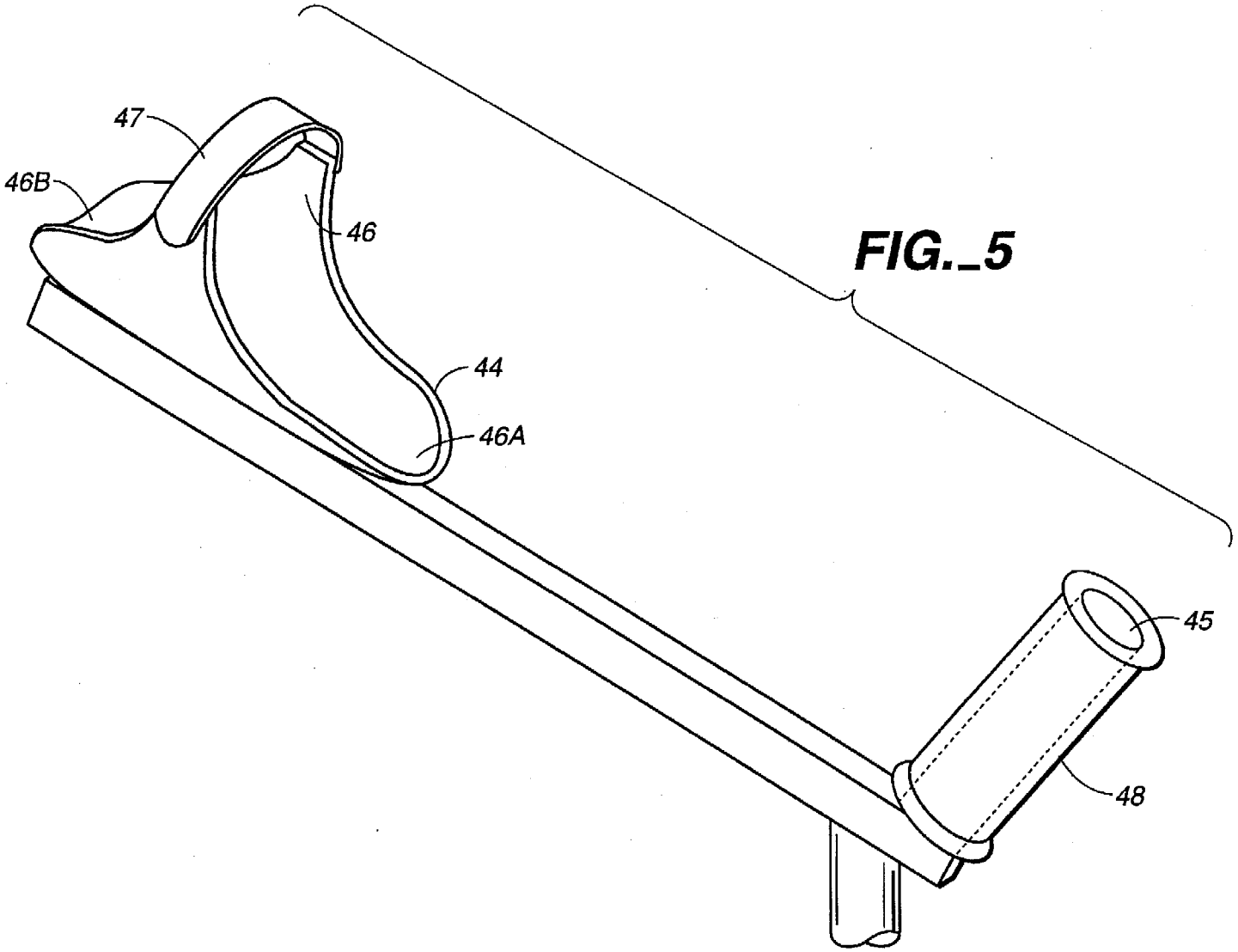
FIG. 5 is an exploded detail view of a second alternative embodiment of the crutch of the present invention.

Referring to FIGS. 4 and 5, alternative embodiments of the forearm crutch of the present invention are provided wherein the forearm support is fixed to the vertical elongate support 12, and the angular support 28 is omitted. FIG. 4 illustrates a crutch 10 having the shaft 24 of the vertical elongate support 12 attached to the forearm support 14 within 0 to 5 inches, preferably 1 to 3 inches, of second end 16, while FIG. 5 depicts the attachment point to be within 0 to 5 inches, preferably 1 to 3 inches, of the first end 15 of the forearm support 14. In the embodiment of FIG. 4, the shaft 24 is secured to a shaft 70, immovably fixed to the arm 40 of the forearm support 14. In this embodiment, it is most preferred that the shaft 24 be secured to the forearm support 14 within 1 to 3 inches, preferably 0 to 2 inches, on either side of axis CC. However, It is understood that the vertical support 12 may attach to the forearm support 14 at any point along the linear dimension of the forearm support 14. A simple pin 54 and corresponding aperture 55 is employed to secure the components, however any means known to the art, including any mentioned herein with respect to any embodiment, may be employed. The crutch of FIG. 5 illustrates two further aspects of the present invention. In this embodiment, the shaft 24 of the vertical elongate support 12 is directly and immovably attached to the forearm support 14 about a point 0 to 5 inches, preferably 1 to 3 inches, behind the handle 45, and the forearm support 14 is itself nonadjustable about its linear dimension. In this embodiment, there is a single arm 72 to which the forearm cradle 46 and handle 45 are immovably attached. Preferably, the arm 72 is formed of a single piece of appropriate material, e.g. metal or durable polymeric material, with the handle 45 an integral part thereof, and the cradle 46 is secured thereto.

Of course, each of the embodiments described herein could be made by appropriately forming and joining individual components. Additionally, the embodiments could be manufactured in a single, or substantially single piece, and movable elements added as required. Furthermore, the various features and aspects of the individual embodiments above could be combined as appropriate. For example the crutch 12 could be manufactured wherein the shaft 24, or the entire vertical support 12, is a single piece, and the forearm support 14 mechanically communicates therewith in either an adjustable or fixed manner, as described in accordance with any embodiment.

The foregoing embodiments are however, intended to be illustrative only, and it is within the scope of the present invention to attach the vertical support 12 anywhere along the length of the forearm support 14, between the first end 15 and second end 16 thereof, to attain the range of comfort and stability advantages afforded by the ranges of relative positioning of the vertical support 12 about the forearm support 14 and angle θ as described above and as evidenced in the Examples below. It is thus contemplated that the crutch 10 could be manufactured with any angle θ described in connection with the preferred embodiment, and/or with the vertical elongate support 12 attached to the forearm support 14 at any point along its linear dimension. Preferably, a series of crutches 10 would be manufactured, each with a discrete angle θ and range of relative positioning of the vertical support 12 about the forearm support 14, to enable the physician or user to select the crutch 10 most closely suited to the user's disability and physique.

EXPERIMENTAL

To determine the effectiveness of weight transfer from the user's hands to forearm, strain gauges were placed about the handle 45 and the preferred embodiment of the walking aid 10 employed to support the body weight. Static and dynamic strain measurements were made to ascertain the load borne by the user's hands at various angles theta (θ) formed by the forearm support 14 of the forearm cradle 46 relative to the vertical elongate support 12. A Micro Engineering PA06-25OBB-350EN strain gauge mounted on the handle 45 proximal to the user's hand. Utilizing a nine volt direct current power supply, a Wheatstone Bridge with adjustable three hundred and fifty ohm resistors on each leg was connected to the strain gauge, and an ammeter was connected to the Wheatstone bridge to measure changes in micro amperage as the strain gauge was placed under load. The vertical elongate shaft 12 was attached to the forearm support 14 at a point five centimeters (2 inches) behind the handle 45. Various angles were tested and results are shown in the Table I below.

Table I shows the results of static testing under the conditions outlined above.

TABLE I

| | | | |
|---|---|---|---|
| Angle of Support (Degrees) | 25 | 50 | 75 |
| Body Weight Supported by Forearm (Percent) | 2 | 29 | 43 |

It can be readily seen that the forearm crotch of the present invention effectively reduces weight borne by the user's hands as the support angle θ approaches the maximum of about eighty-nine degrees as measured from the vertical.

Dynamic testing was also conducted, with test subjects utilizing a swing-through gait of both legs simultaneously so that essentially no body weight was supported by the legs. The subject moved forward at a velocity of three feet per second. Strain gauge measurements were taken as above. Results are shown in Table II below.

TABLE II

| | | | |
|---|---|---|---|
| Angle of Support (Degrees) | 25 | 50 | 75 |
| Body Weight Supported By Forearm (Percent) | 2 | 32 | 52 |

Under dynamic load, with the vertical elongate shaft 12 five centimeters (2 inches) behind the handle 45, the vertical shaft flexed, increasing the preselected angle θ of the forearm support up to approximately twenty degrees.

Tables III and IV show results obtained under static and dynamic load conditions, respectively, when the vertical shaft was attached to the support arm directly beneath the user's elbow joint. All other conditions, and strain gauge measurements were as above.

TABLE III

| | | | |
|---|---|---|---|
| Angle of Support (Degrees) | 25 | 50 | 75 |
| Body Weight Supported By Forearm (Percent) | 2 | 29 | 43 |

TABLE IV

| | | | |
|---|---|---|---|
| Angle of Support (Degrees) | 25 | 50 | 75 |
| Body Weight Supported By Forearm (Percent) | 2 | 32 | 43 |

Under dynamic load, the vertical shaft 12 did not flex, and the angle θ of the forearm support 14 beneficially remained at its preselected value.

Some test subjects who needed the forearm crutch primarily for weight support (as opposed to maintaining balance) reported that the crutch of the present invention felt more stable when the vertical shaft was attached to the forearm support beneath the elbow. When the angle θ of the forearm support was set at 25 degrees, the user's elbows were flexed to 165 degrees. When the angle θ of the forearm support was set at 40 degrees, the user's elbows were flexed to 140 degrees. When the angle θ of the forearm support was set at 75 degrees, the user's elbows were flexed to 115 degrees. In general, user stability, especially in the dynamic mode is maximized as the angle θ approaches the minimum of about 25 degrees, and the user's elbows are at their point of fullest extension or greatest flex angle. On the other hand comfort is maximized with the reverse conditions, i.e. a large angle θ of 89 degrees and smallest flex angle of the elbow.

It can be seen that the walking aid of the present invention is effective to transfer at least 30 percent of the user's weight from the hands to the forearm, preferably at least 40 percent more preferably at least 50 percent and most preferably at least about 60 percent of the weight is transferred to the forearm.

Other embodiments of the invention would become readily apparent to one skilled in the art. For example, since the walking aid of the present invention is easy to manufacture, the vertical elongate shaft could be formed as a single piece thus obviating the need for a height adjustment. Various lengths could thus be premanufactured and selected to fit the user. Similarly, the forearm support assembly could be manufactured as a unitary piece of various fixed lengths. The forearm cuff could be extended about the axis BB, so that forearms of various lengths could be comfortably accommodated, thus eliminating the need for adjustable sections.

Although described in terms of the presently preferred embodiment, it is to be understood that such disclosure is not to be interpreted as limiting. Various modifications and alterations will no doubt occur to one skilled in the art after having read the above disclosure. Accordingly, it is intended that the appended claims be interpreted as covering all such modifications and alterations as fall within the true spirit and scope of the invention.

What is claimed is:

1. A walking aid comprising a vertical elongate support, having a lower end adapted for contact with a walking surface, and an upper end in mechanical communication with a forearm support;

a forearm support having a first end and a second end, the first end including a handle, the forearm support having a forearm cuff attached thereto between said first and second ends, the handle and forearm cuff being linearly disposed about a longitudinal axis and being inclined relative to the vertical elongate support by an angle of between about 25 and 89 degrees, and the forearm support being attached to the vertical elongate support at a point intermediate to said first and second ends; and wherein the at least about 30 percent of the user's body weight is substantially transferred to said walking surface through the forearm support.

2. The walking aid of claim 1 wherein:

the forearm cuff comprises an arcuate forearm cradle, having a posterior end, a center axis and a proximal end, the forearm cradle being generally congruent to an ulnar surface of a user's forearm, and a restraining means for securing said user's forearm therein.

3. The walking aid of claim 2 wherein

The vertical support is attached to the forearm support about a point intermediate to the handle and a center axis of the forearm cradle.

4. The walking aid of claim 1 wherein the handle of the forearm support is tilted downward by an angle of between about 0–40 degrees, and is inclined inwardly toward the user by an angle of between about 0–20 degrees.

5. The walking aid of claim 4 wherein said downward tilt and inward inclination of the handle urges an ulnar border of the user's hand to be pronated about five degrees, and an ulnar deviation of about fifteen degrees.

6. The walking aid of in claim 1 and further including:

an angular support means to adjustably secure said upper end of the vertical elongate shaft to the forearm support whereby said forearm support can be adjusted about a range of about 25 to 89 degrees relative to the vertical support.

7. The walking aid of claim 1 wherein the vertical elongate support comprises an upper shaft in contact with the forearm support, a lower shaft for contacting the walking surface, and an intermediate shaft, intermediate to and in contact with the upper and lower shafts and in telescoping contact with at least one of the upper and lower shafts whereby the vertical support is adjustable in length.

8. The walking aid of claim 7 wherein the upper, lower and intermediate shafts are formed of a tubular material, each of said shafts mating in a telescoping fashion.

9. The walking aid of claim 8 further including a resilient tip affixed to a lower end of the lower shaft.

10. The walking aid of claim 1 wherein the handle includes an outer layer of resilient material to facilitate gripping thereof.

11. The walking aid of claim 1 and further including a compressible shock absorbing means within the vertical elongate shaft.

12. The walking aid of claim 11 wherein the shock absorbing means comprises a biasing means disposed intermediate to the upper and intermediate shafts.

13. The walking aid of claim 1 wherein at least about 40 percent of the user's body weight is transferred to said walking surface through the forearm support.

14. The walking aid of claim 1 wherein at least about 50 percent of the user's body weight is transferred to said walking surface through the forearm support.

15. A walking aid comprising a vertical elongate shaft, having a lower end adapted for contact with a walking surface, and an upper end in mechanical communication with a forearm support;

a forearm support having a first end and a second end, the first end including a handle, the forearm support having a forearm cuff attached thereto between said first and second ends, the handle being tilted downward by an angle of between about 0–40 degrees, and further being inclined inwardly toward the user by an angle of between about 0–20 degrees, the handle and forearm cuff being in mechanical communication with each other about a longitudinal axis thereof, the forearm cuff including a forearm cradle, substantially congruent with an ulnar surface of a forearm, and a restraining means for securing said forearm therein;

an angular support means to secure said upper end of the vertical elongate shaft to the forearm support assembly about a range of about 25 to 89 degrees relative to the vertical support;

a shock absorbing means, intermediate to the vertical shaft and the forearm support and wherein;

at least 30 percent of the user's body weight is transferred to said walking surface through the forearm support.

16. The walking aid of claim 15 and further including an intermediate shaft, in mechanical communication with an intermediate to the upper and lower shafts, and in telescoping contact with at least one of the upper and lower shafts whereby the vertical support is adjustable in length.

17. In a walking aid of the type having a forearm support and vertical support, the improvement comprising:

a linearly disposed handle and forearm cuff, the handle being tilted downward by an angle of between about 0–40 degrees, and further being inclined inwardly toward the user by an angle of between about 0–20 degrees, the forearm cuff including a forearm cradle, substantially congruent to an ulnar surface of a forearm, and a restraining means for securing said forearm therein;

the vertical elongate support including an upper shaft in contact with the forearm support, a lower shaft for contacting a walking surface, and an intermediate shaft, intermediate to and in contact with the upper and lower shafts and in telescoping contact with at least one of the upper and lower shafts whereby the vertical support is adjustable in length, the vertical support further including a compressible shock absorbing means;

an angular support means to adjustably secure said upper end of the vertical elongate shaft to the forearm support assembly about a point intermediate to the handle and the forearm support, whereby said arm support assembly can be adjusted about a range of about 25 to 89 degrees relative to the vertical support; and wherein at least 30 percent of the user's body weight is transferred to said walking surface through the forearm support.

18. The walking aid of claim 17 wherein at least about 40 percent of the user's body weight transmitted to a walking surface by the forearm support.

19. The walking aid of claim 17 wherein the vertical support is secured to the forearm support about a point posterior to the forearm cradle.

20. The walking aid of claim 17 wherein said downward tilt and inward inclination of the handle urges an ulnar border of the user's hand to be pronated about five degrees, and an ulnar deviation of about fifteen degrees.

* * * * *